US007487960B2

(12) United States Patent
Wang et al.

(10) Patent No.: US 7,487,960 B2
(45) Date of Patent: Feb. 10, 2009

(54) DOCUMENT FEEDER

(75) Inventors: Chung-Kai Wang, Taipei (TW); Chien-Kuo Kuan, Taipei (TW); Chi-Jin Song, Taipei (TW); Hsi-Yu Chen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 220 days.

(21) Appl. No.: 11/422,553

(22) Filed: Jun. 6, 2006

(65) Prior Publication Data

US 2008/0012204 A1 Jan. 17, 2008

(30) Foreign Application Priority Data

Feb. 10, 2006 (TW) ..... 95104533 A

(51) Int. Cl.
*B65H 3/52* (2006.01)

(52) U.S. Cl. ..... 271/121; 271/117

(58) Field of Classification Search ..... 271/10.13, 271/109, 114, 115, 117, 118, 121, 122
See application file for complete search history.

(56) References Cited

U.S. PATENT DOCUMENTS

| | | | | |
|---|---|---|---|---|
| 5,921,539 | A * | 7/1999 | Westcott et al. | 271/10.03 |
| 6,764,072 | B2 * | 7/2004 | Gaarder | 271/121 |
| 2004/0188917 | A1 * | 9/2004 | Koh et al. | 271/117 |

* cited by examiner

*Primary Examiner*—Kaitlin S Joerger
(74) *Attorney, Agent, or Firm*—Apex Juris, pllc; Tracy M Heims

(57) ABSTRACT

A document feeder for feeding a plurality of paper sheets one by one includes an engaging module and a detachable roller module. The detachable roller module is detachably mounted on the engaging module and includes a frame, a paper separation roller axel, a fixing element and a paper separation roller. The paper separation roller axel is supported on the frame. The fixing element is pivotally coupled to the paper separation roller axel for positioning the detachable roller module on the engaging module. The paper separation roller is disposed within the fixing element and sheathed around the paper separation roller axel.

8 Claims, 6 Drawing Sheets

DOCUMENT FEEDER

FIELD OF THE INVENTION

The present invention relates to a document feeder, and more particularly to a document feeder used in an image scanning apparatus for feeding a plurality of paper sheets one by one.

BACKGROUND OF THE INVENTION

Image scanners are widely used for scanning documents. For a purpose of successively scanning many paper sheets at a time, an automatic document feeder (ADF) is used for feeding the paper sheets into the image document one by one. By means of the automatic document feeder, the efficiency of scanning documents is enhanced.

Generally, an automatic document feeder is assembled by combining many mechanical elements including for example at least a roller, a shaft, a driving motor, a gear set and the like. In a case that the automatic document feeder has been used for a long term, some of these mechanical elements may be suffered from abrasion to some extent. For example, the surface material of the roller is readily abraded when the roller has rolled and contacted too many documents. Under this circumstance, since the friction resulted from the surface material of the roller is largely reduced or eliminated, the function of feeding the document becomes abnormal or two or more paper sheets are fed to the image scanner at a time. Therefore, the scanning operation is adversely affected. Similarly, the shaft hole is readily subject to abrasion when the shaft has been rotated and contacted the shaft hole for a long time.

A document feeder is described in Taiwanese Patent No. 593107, entitled "Sheet feeder with modular roller support and drive assembly, and the contents of which are hereby incorporated by reference. In the document feeder of Taiwanese Patent Gazette No. 593107, certain elements are formed as a replaceable module. If one or some elements contained in the replaceable module are damaged, the replaceable module can be detached from the automatic document feeder and replaced with a new one. The contents of this patent will be illustrated as follows in more details.

Referring to FIG. 1(*a*), a schematic view of a document feeder 10 described in Taiwanese Patent Gazette No. 593107 is illustrated. As shown in FIG. 1, the document feeder 10 principally comprises a document input tray 11, a driving motor 12 and a modular roller 20. The modular roller 20 is rotatably supported on the document input tray 11. The driving motor 12 is disposed at an end of the document input tray 11 for driving rotation of the modular roller 20. During operation of the automatic document feeder 10, the paper sheets are fed from upstream to downstream of the document input tray 11, i.e. in the direction indicated by the arrow A.

Referring to FIG. 1(*b*), a schematic view of the modular roller 20 is illustrated. The modular roller 20 principally comprises a shaft 21, a roller bogie 22 and a pair of spaced bogie support load arms 210, 212. By means of the bogie support load arms 210 and 212, the roller bogie 22 is mounted on the shaft 21. An axially gear 201 is driven by the driving motor 12 as shown in FIG. 1(*a*) so as to permit rotation of the whole modular roller 20. In addition, the modular roller 20 further comprises a swing arm 23 axially supported on the shaft 21. A clutch gear 231 is received within the swing arm 23 and synchronously rotated with the axially gear 201 so as to transmit a gear set 221 beside the roller bogie 22 to rotate.

The modular roller 20 further comprises a stack stop 24 for feeding control of a stack of paper sheets placed on the document input tray 11.

The whole roller bogie 22 can be swung upwardly or downwardly by the related components of the swing arm 23 (not shown). For feeding the paper sheets with various thickness or height, a motion limit hook 232 is also integrally formed on the swing arm 23 for engagement with a paper separation roller axle 261, which is protruded from a paper separation roller (not shown) of the roller bogie 22, to restrain swinging height of roller bogie 22. The roller bogie 22 has a pre-feed roller 25 for engaging the top paper sheet to be removed from the stack of paper sheets. When the top paper sheet is transported with rotation of the pre-feed roller 25, the paper separation roller is also rotated to separate the top paper sheet from the stack of paper sheets so as to pick a single paper.

Referring to FIGS. 2(*a*), 2(*b*) and 2(*c*), schematic partial views of the roller bogie 22 mounted onto the shaft 21 are illustrated. As previously described, the roller bogie 22 is the major component of the modular roller 20 responsible for the paper picking operation. During the paper picking operation, the pre-feed roller 25 and the separation roller 26 of the roller bogie 22 should be rotated and the whole roller bogie 22 needs to be swung upwardly or downwardly. As a consequence, the roller bogie 22 should be pivotally mounted on the shaft 21.

As shown in FIG. 2(*a*), one end of the separation roller axle 261 of the separation roller 26 is movably received in a bearing aperture 291 of a support bearing 29. The support bearing 29 can be deflected to a certain extent such that the bearing aperture 291 is selectively opened or closed. As shown in FIG. 2(*b*), in a case that the bearing aperture 291 is opened, the separation roller 26 or the whole roller bogie 22 can be detached and then replaced with a new one. Whereas, in a case that support bearing 29 is deflected to have the bearing aperture 291 closed, as is shown in FIG. 2(*c*), the separation roller axle 261 of the separation roller 26 is enclosed and movably supported by the bearing aperture 291.

As previously described, the surfaces of the pre-feed roller 25 and the separation roller 26 of the roller bogie 22 are readily abraded when the document feeder 10 has been used for a long term. As a consequence, the function of performing the paper picking operation is impaired. Since the modular roller 20 is replaceable, the user can replace the modular roller 20 with a new one. The replacing task is convenient and can be serviced by the user without the necessity to involve a skilled service technician.

Although the modular roller 20 is easily replaced, there are still some drawbacks. For example, many components included in the modular roller 20 other than the pre-feed roller 25 or the separation roller 26 are not readily damaged components. Discarding these undamaged components along with the damaged pre-feed roller 25 or separation roller 26 is neither cost-effective nor environmentally-friendly. In contrast, if only the roller bogie 22 is replaced, the problem of impairing the paper picking operation remains because the bearing aperture 291 is still abraded upon rotation of the separation roller 26. Moreover, during the process of detaching the roller bogie 22, several complicated gears in the vicinity of the roller bogie 22 become hindrance from placing the roller bogie 22 in the right position.

In views of the above-described disadvantages resulted from the prior art, the applicant keeps on carving unflaggingly to develop a document feeder according to the present invention through wholehearted experience and research.

SUMMARY OF THE INVENTION

It is an object of the present invention to provide a document feeder, which has simplified structure and the components possibly abraded upon rotation of the roller axel are replaceable.

In accordance to an aspect of the present invention, there is provided a document feeder for feeding a plurality of paper sheets one by one. The document feeder comprises an engaging module and a detachable roller module. The detachable roller module is detachably mounted on the engaging module and comprises a frame, a paper separation roller axel, a fixing element and a paper separation roller. The paper separation roller axel is supported on the frame. The fixing element is pivotally coupled to the paper separation roller axel for positioning the detachable roller module on the engaging module. The paper separation roller is disposed within the fixing element and sheathed around the paper separation roller axel.

In an embodiment, the paper separation roller and the fixing element are coaxially sheathed around the paper separation roller axel.

In an embodiment, the engaging module comprises two bearing apertures, each of which has a respective first protrusion edge.

In an embodiment, the fixing element comprises a fixing plate and two connecting parts. The two connecting parts are vertically extended from bilateral sides of the fixing plate. Each of the connecting parts has a second protrusion edge including a notch structure. The first protrusion edges of the engaging module are penetrated through corresponding notch structures and received within corresponding second protrusion edges.

In an embodiment, the paper separation roller is arranged between the two connecting parts.

In an embodiment, the fixing element further comprises a fixing buckle and the engaging module has a fixing buckle hole to be engaged with the fixing buckle.

In an embodiment, the document feeder further comprises a document input tray and a driving shaft. The document input tray is used for placing thereon the plurality of paper sheets. The engaging module is pivotally coupled to the driving shaft.

In an embodiment, the detachable roller module further comprises a pre-feed roller axel, a pre-feed roller and a gear set. The pre-feed roller axel is pivotally coupled to the frame. The pre-feed roller is sheathed around the pre-feed roller axel. The gear set is mounted on the frame The above objects and advantages of the present invention will become more readily apparent to those ordinarily skilled in the art after reviewing the following detailed description and accompanying drawings, in which:

BRIEF DESCRIPTION OF THE DRAWINGS

FIG. 1(*b*) is a schematic perspective view illustrating the modular roller used in the document feeder of FIG. 1(*a*);

DETAILED DESCRIPTION OF THE PREFERRED EMBODIMENT

Figure 1A:
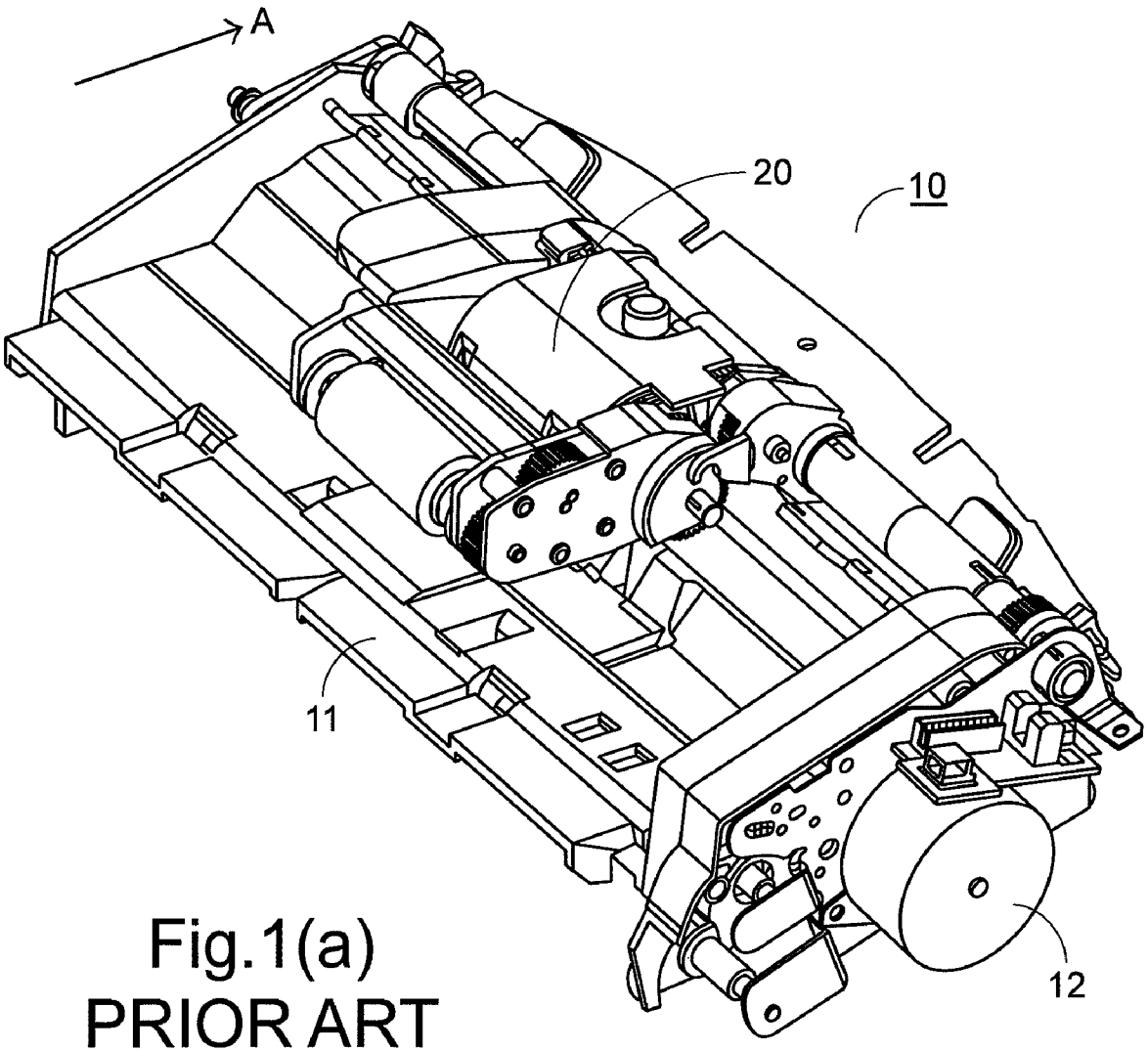
Fig.1(a) PRIOR ART
FIG. 1(*a*) is a schematic perspective view of a conventional document feeder.
Figure 1B:
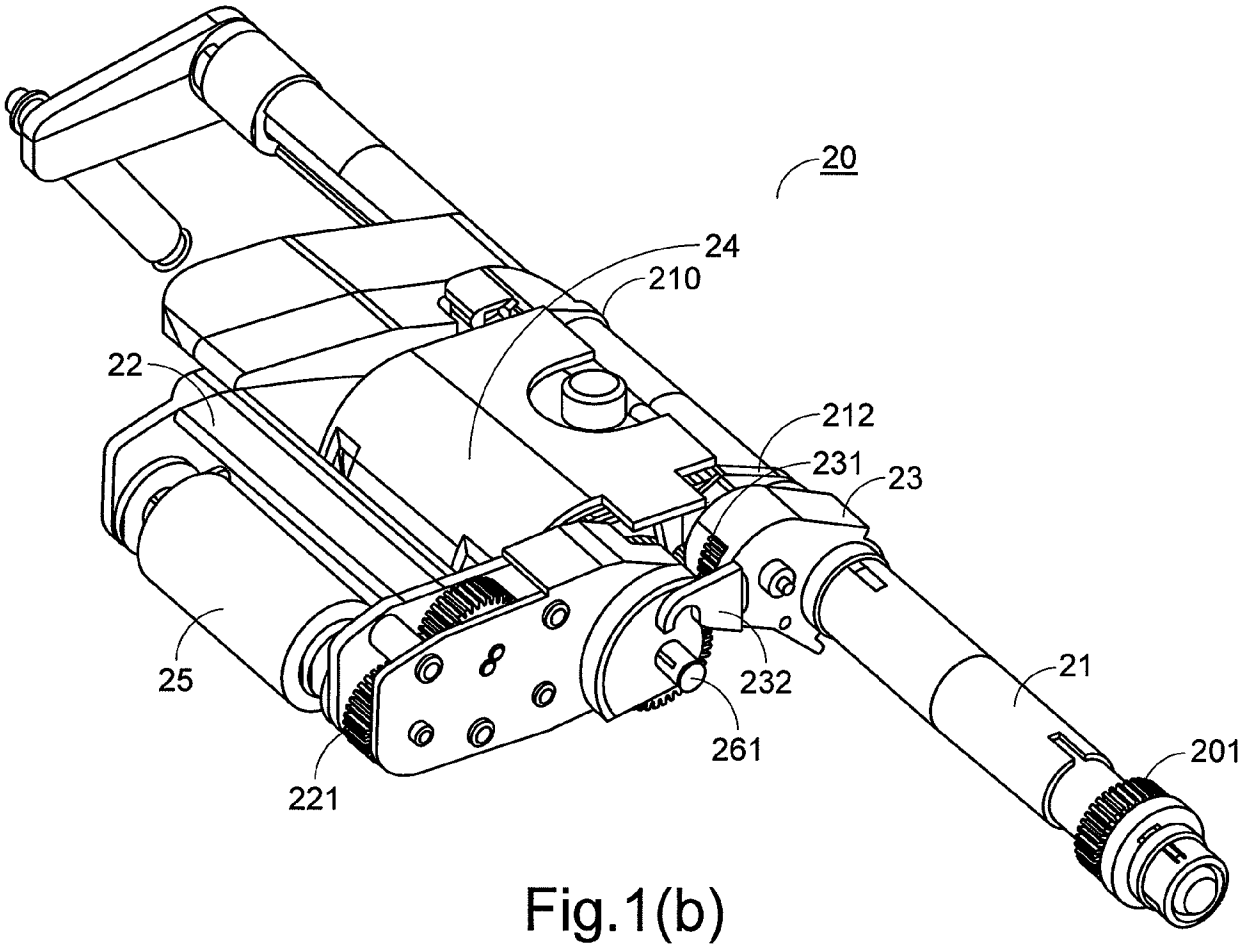
Fig.1(b) PRIOR ART
Figure 2C:
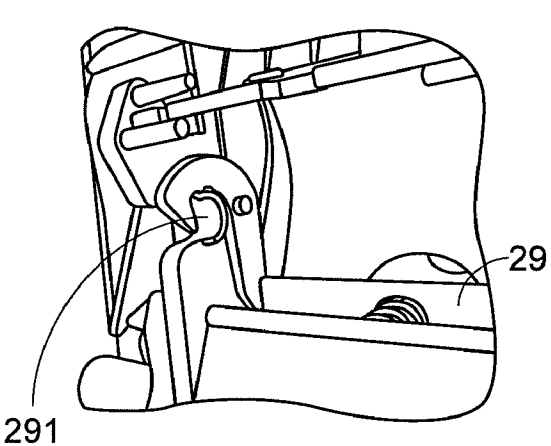
Fig.2(c) PRIOR ART
FIGS. 2(*a*), 2(*b*) and 2(*c*) are schematic partial views illustrating the roller bogie mounted onto the shaft.
Figure 2B:
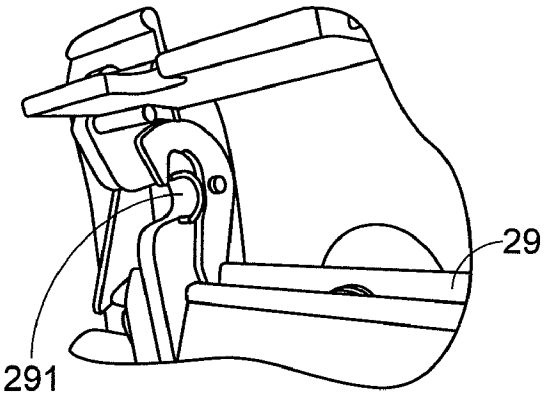
Fig.2(b) PRIOR ART
Figure 2A:
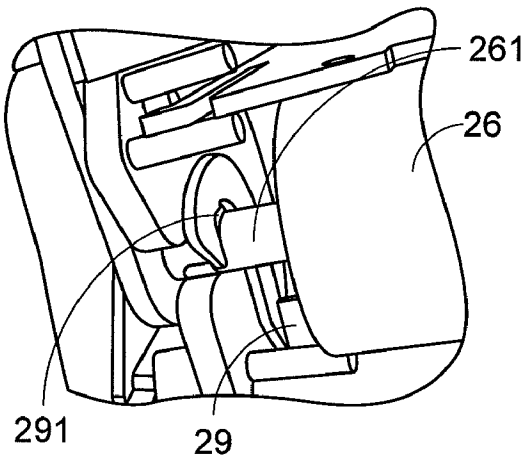
Fig.2(a) PRIOR ART
Figure 3:
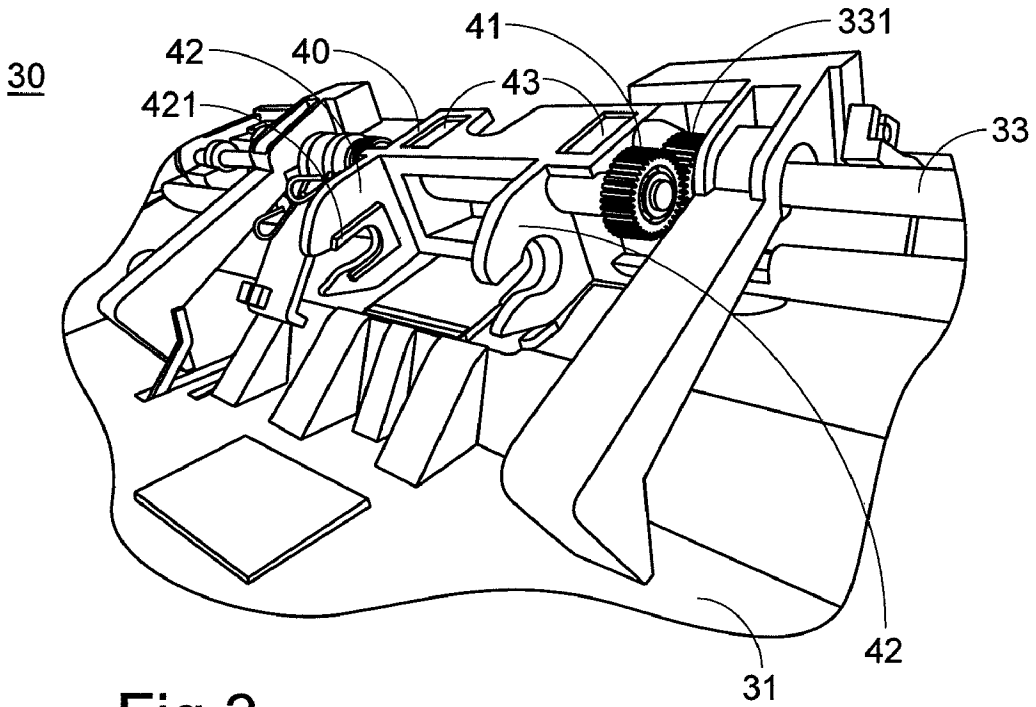
FIG. 3 is a schematic view of a document feeder according to a preferred embodiment of the present invention.
Figure 3:
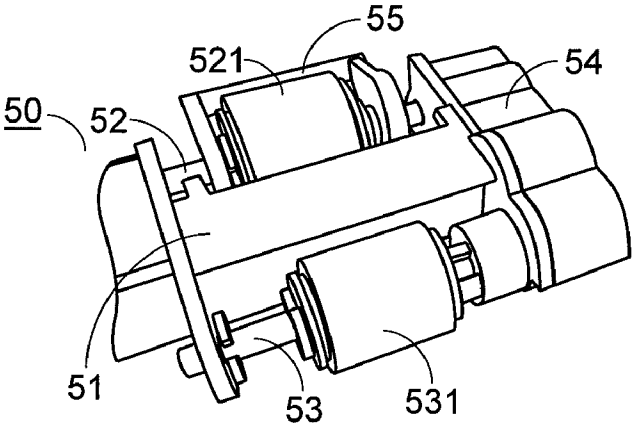

Referring to FIG. 3, a schematic view of a document feeder according to a preferred embodiment of the present invention is illustrated. In this embodiment, the document feeder 30 comprises a document input tray 31, a driving motor (not shown), an engaging module 40, a detachable roller module 50 and a driving shaft 33. The document input tray 31 is used for placing thereon the paper sheets to be fed into the document feeder 30. The engaging module 40 is pivotally coupled to the driving shaft 33.

The engaging module 40 comprises two bearing apertures 42 and two fixing buckle holes 43. Each of the bearing apertures 42 has a first protrusion edge 421. The engaging module 40 is pivotally coupled to the driving shaft 33 and the driving shaft 33 is pivotally mounted on the document input tray 31. The driving shaft 33 is driven by the driving motor to rotate. The driving shaft 33 further comprises a driving gear 331, which is synchronously rotated with the driving shaft 33. The engaging module 40 comprises further comprises an idle gear 41 engaging with the driving gear 331. When the driving shaft 33 is driven by the driving motor to rotate, the idle gear 41 is driven by the driving gear 331 to rotate.

The detachable roller module 50 comprises a frame 51, a paper separation roller axel 52, a paper separation roller 521, a pre-feed roller axel 53, a pre-feed roller 531, a gear set 54 and a fixing element 55. The paper separation roller axel 52 and the pre-feed roller axel 53 are movably supported on the frame 51. The paper separation roller 521 and the pre-feed roller 531 are sheathed around the paper separation roller axel 52 and the pre-feed roller axel 53, respectively, so that the paper separation roller 521 and the pre-feed roller 531 are rotatable within the frame 51. The gear set 54 is mounted on the frame 51 at the location corresponding to the idle gear 41. When the detachable roller module 50 is mounted onto the engaging module 40, the gear set 54 will engage with the idle gear 41. The gear set 54 is composed of several gears pivotally coupled to the paper separation roller axel 52 and the pre-feed roller axel 53. When the idle gear 41 is rotated, the gears of the gear set 54 are driven to rotate so as to permit rotation of the paper separation roller 521 and the pre-feed roller 531, which are mounted on the paper separation roller axel 52 and the pre-feed roller axel 53, respectively. The operation principles of permitting rotation of the paper separation roller 521 and the pre-feed roller 531 are known to those skilled in the art, and are not redundantly described herein.

Figure 4B:
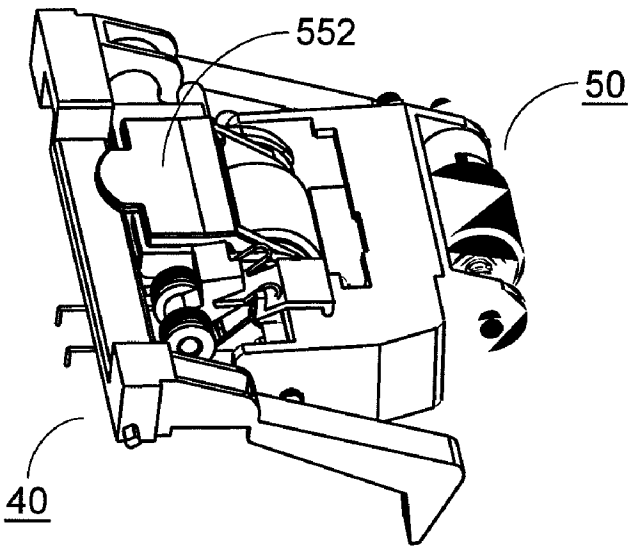
FIGS. 4(*a*) and 4(*b*) are perspective views respectively illustrating detachment and attachment of the engaging module and the detachable roller module.
Figure 4A:
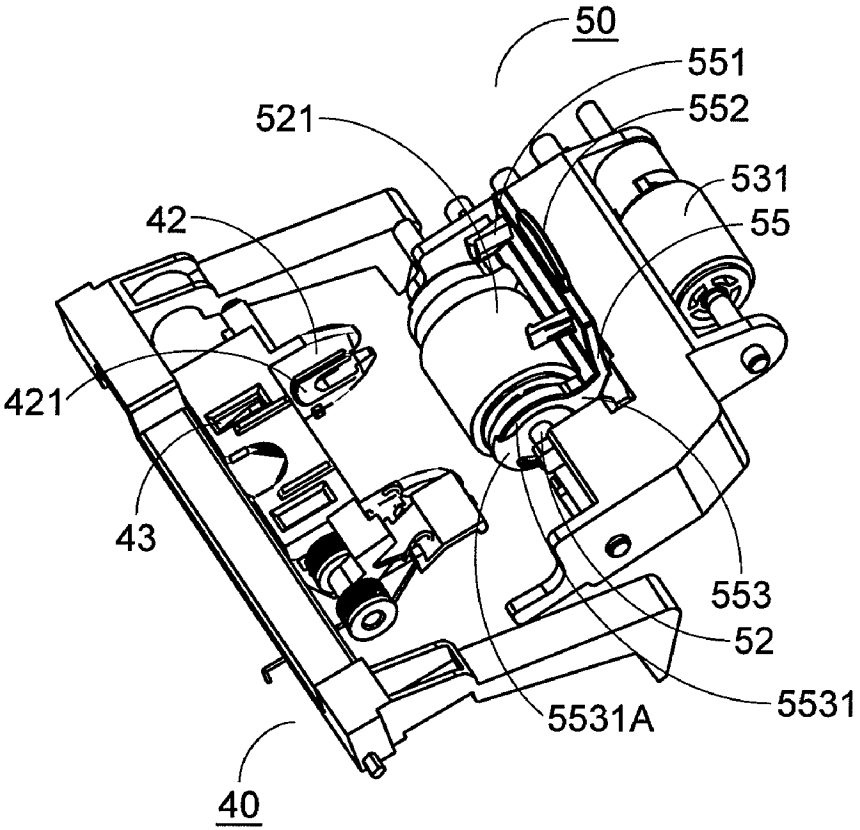
Figure 5B:
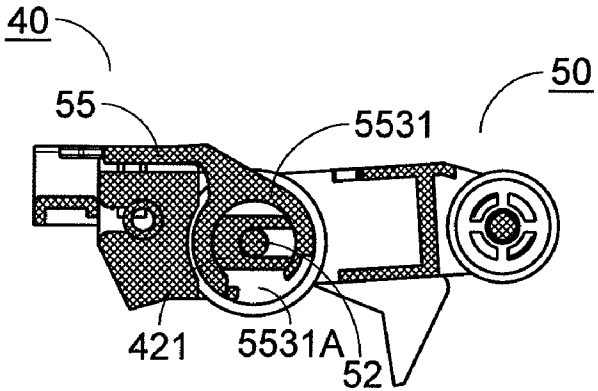
FIGS. 5(*a*) and 5(*b*) are cross-sectional views respectively illustrating detachment and attachment of the engaging module and the detachable roller module.
Figure 5A:
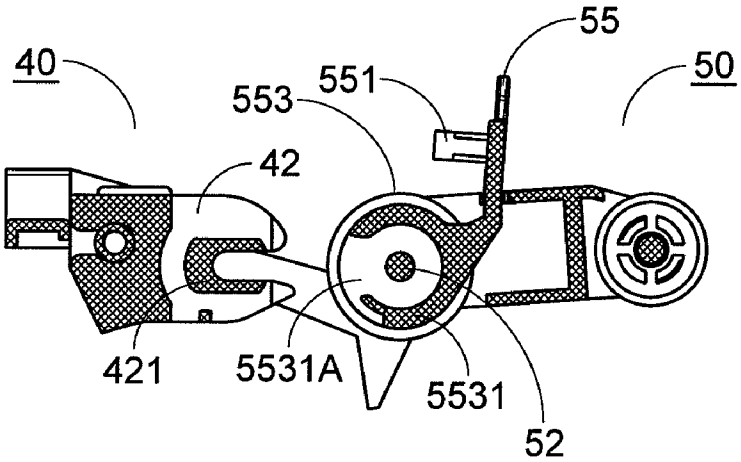

FIGS. 4(*a*) and 4(*b*) are perspective views respectively illustrating detachment and attachment of the engaging module 40 and the detachable roller module 50. FIGS. 5(*a*) and 5(*b*) are schematic cross-sectional views respectively illustrating detachment and attachment of the engaging module 40 and the detachable roller module 50.

As shown in FIGS. 4(*a*) and 5(*a*), the fixing element 55 includes two fixing buckles 551, a fixing plate 552 and two connecting parts 553. The connecting parts 553 are vertically extended from bilateral sides of the fixing plate 552. Each of the connecting parts 553 has a second protrusion edge 5531 including a notch structure 5531A therein.

As shown in FIGS. 4(*b*) and 5(*b*), in order to attach the engaging module 40 with the detachable roller module 50, the first protrusion edges 421 of the engaging module 40 are penetrated through the notch structures 5531A and received within the corresponding second protrusion edges 5531, so that the paper separation roller axel 52 is received in the corresponding bearing apertures 42. After the fixing buckles 551 of the fixing element 55 are engaged with corresponding fixing buckle holes 43, the detachable roller module 50 is securely positioned on the engaging module 40.

During the paper picking operation, the paper separation roller axel 52 and the paper separation roller 521 are rotated to separate the top paper sheet from a stack of paper sheets so as to pick a single paper sheet.

Since the detachable roller module 50 is coupled to the engaging module 40 by the engagement between the connecting parts 553 and the corresponding bearing apertures 42, the bearing apertures 42 will not be abraded upon rotation of the paper separation roller axel 52. Instead, when the paper separation roller axel 52 is rotated, the connecting parts 553 of the fixing element 55 of the detachable roller module 50 are possibly abraded. In other words, if document feeder fails to normally perform the paper picking operation, the detachable roller module 50 can be detached from the engaging module and replaced with a new one. Under this circumstance, the most possibly abraded component, i.e. the fixing element 55, is also replaced because such component is integrated into the detachable roller module 50.

From the above description, the document feeder of the present invention is simplified in structure and the components possibly abraded upon rotation of the roller axel are replaceable. Therefore, the problems as described above will be effectively overcome.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A document feeder for feeding a plurality of paper sheets one by one, said document feeder comprising:

an engaging module; and a detachable roller module detachably mounted on said engaging module, and comprising:

a frame;

a paper separation roller axel supported on said frame;

a fixing element pivotally coupled to said paper separation roller axel for positioning said detachable roller module on said engaging module; and a paper separation roller disposed within said fixing element and sheathed around said paper separation roller axel.

2. The document feeder according to claim 1 wherein said paper separation roller and said fixing element are coaxially sheathed around said paper separation roller axel.

3. The document feeder according to claim 2 wherein said engaging module comprises two bearing apertures, each of which has a respective first protrusion edge.

4. The document feeder according to claim 3 wherein said fixing element comprises:

a fixing plate; and two connecting parts vertically extended from bilateral sides of said fixing plate, each of said connecting parts having a second protrusion edge including a notch structure, wherein said first protrusion edges of said engaging module are penetrated through corresponding notch structures and received within corresponding second protrusion edges.

5. The document feeder according to claim 4 wherein said paper separation roller is arranged between said two connecting parts.

6. The document feeder according to claim 4 wherein said fixing element further comprises a fixing buckle and said engaging module has a fixing buckle hole to be engaged with said fixing buckle.

7. The document feeder according to claim 1 further comprising:

a document input tray for placing thereon said plurality of paper sheets; and a driving shaft, wherein said engaging module is pivotally coupled to said driving shaft.

8. The document feeder according to claim 1 wherein said detachable roller module further comprises:

a pre-feed roller axel pivotally coupled to said frame;

a pre-feed roller sheathed around said pre-feed roller axel; and a gear set mounted on said frame.

* * * * *